United States Patent [19]

Lemke

[11] 4,089,770

[45] May 16, 1978

[54] ELECTROLYTIC CELL

[75] Inventor: Charles H. Lemke, Newark, Del.

[73] Assignee: E. I. Du Pont de Nemours and Company, Wilmington, Del.

[21] Appl. No.: 814,432

[22] Filed: Jul. 11, 1977

[51] Int. Cl.[2] ..... C25C 3/08; C25C 3/02

[52] U.S. Cl. ..... 204/247; 204/68; 204/237; 204/245

[58] Field of Search ..... 204/245–247, 204/237, 68, 243–244

[56] References Cited

U.S. PATENT DOCUMENTS

| | | | |
|---|---|---|---|
| 2,041,821 | 6/1946 | Gardiner | 204/247 |
| 3,607,684 | 9/1971 | Kuhn | 204/68 X |
| 3,962,064 | 6/1976 | Brut et al. | 204/68 X |

*Primary Examiner*—John H. Mack
*Assistant Examiner*—D. R. Valentine

[57] ABSTRACT

An electrolytic cell for the electrochemical separation of selected metals from electrodissociatable compounds thereof in the molten state utilizing as electrode separator a plurality of solid electrolyte tubes which, under the influence of an electrical potential, are permeable to the flow of selected cations, but impermeable to fluids and the flow of anions and other cations.

24 Claims, 2 Drawing Figures

ELECTROLYTIC CELL

BACKGROUND OF THE INVENTION

The invention is directed to an improved electrolytic cell for the separation of metals from electrodissociatable compounds in the molten state. It is particularly useful for the separation of alkali metals.

The metals most frequently made by electrolysis of electrodissociatable compounds in the molten state are the alkali metals, particularly sodium and lithium.

A considerable proportion of the elemental alkali metals which are manufactured for commerce is produced by the electrolysis of molten halogen salts of the metals, especially low melting mixtures of such salts with other salts which are inert. For example, sodium metal can be produced by electrolysis of a molten binary mixture comprising calcium chloride and sodium chloride or a ternary mixture such as sodium chloride, calcium chloride and barium chloride. On the other hand, lithium metal is produced by electrolysis of a molten binary mixture comprising potassium chloride and lithium chloride.

The type of electrolytic cell most widely used for the above-described operations is the Downs cell, which is described in U.S. Pat. No. 1,501,756 to J. C. Downs. The Downs-type electrolytic cell basically is comprised of a refractory-lined steel shell for holding the molten salt electrolyte, a submerged cylindrical graphite anode surrounded by a cylindrical steel cathode and a perforated steel diaphragm positioned in the annular space between the electrodes to separate the anode and cathode products. To collect product halogen gas from the anode, the cell is provided with collector means such as an inverted cone which fits over the anode below the surface of the molten bath. Halogen gas (usually chlorine) passes upwardly through the cone and, via appropriate manifold components, from the cell. Similarly, the cathode is also provided with collector means such as an inverted inclined trough which fits over the cathode below the surface of the molten bath. Molten alkali metal rises from the cathode toward the surface of the molten bath, is collected along the inclined surface of the trough and is passed to a vertical riser/cooler in which the molten metal is partially cooled before it is passed to a product receiver.

Despite the current technical and economic superiority of the Downs cell for making alkali metals, particularly sodium and lithium, the cell nevertheless has several disadvantages which are becoming even more highly significant as additional emphasis is placed on energy conservation and the quality of working environment for operating personnel.

For example, in the manufacture of sodium, it is necessary to use a molten salt bath temperature of about 500°-600° C in order to maintain the electrolyte components in the molten state. At this temperature (high with respect to the melting point of sodium) significant amounts of electrolyte salts and alkaline earth metals dissolve in the product sodium and tend to plug the cell riser/cooler. Thus, for reasons of product purity as well as safety of operating personnel, the riser/coolers of Downs cells are equipped with an agitation device of "tickler" by which the salts and extraneous metals which are precipitated therein can be prevented from plugging the riser pipe. Such devices are well known in the art and are described inter alia in U.S. Pat. Nos. 2,770,364, 2,770,592, 3,037,927 and 3,463,721. In addition, the heat produced by the operation of a battery of such electrolytic cells coupled with the necessity of conducting the operation in a closed building present problems of heat discomfort for operating personnel despite the use of extensive ventilation facilities. The waste heat requiring such extensive ventilation is generated by the passage of direct current through the cells and represents a large energy loss in addition to the energy required for the operation of the ventilation system.

Therefore, from the standpoints of energy consumption, product quality and the comfort of operating personnel, it is immensely desirable to have an electrolytic process and cell which is operable at substantially lower temperatures at the same or higher efficiencies.

A most promising route by which these disadvantages of the prior art can be overcome is to employ an electrolytic process in which a solid electrolyte material, which, under the influence of an electrical potential, is permeable to the flow of selected cations, but impermeable to the flow of other species, i.e., fluids, anions and other cations, to separate the anode and cathode compartments of the cell. A basic method for carrying out the electrowinning of alkali metals in this manner is disclosed in U.S. Pat. Nos. 3,404,036 and 3,488,271 to Kummer et al in which a flat plate of sodium beta alumina is used as the solid electrolyte material. A similar method is disclosed in U.S. Pat. No. 3,607,684 to Kuhn in which sheets of beta alumina are used as a diaphragm to separate the anode and cathode compartments of the electrolytic cell.

Though the cells of the prior art, which have employed solid electrolyte material as a separator between the cathode and anode, are effective in carrying out the electrolytic separation of metals from molten salts thereof, such cells have remained largely undeveloped and lack the configuration necessary to obtain efficient continuous operation on a commerical basis. In particular, the cells of the prior art have not been of such design as to provide for safe continuous cell operation in the event of breakage of the fragile solid electrolyte material, nor do such prior art cells permit efficient use of electrical energy and factory floor space by providing an acceptable ratio of solid electrolyte surface area to cell volume.

BRIEF DESCRIPTION OF THE INVENTION

In view of the shortcomings of the electrolytic cells in the prior art, the invention is directed to a cell for the electrochemical separation of selected metals from electrodissociatable compounds thereof in the molten state comprising (a) an enclosed shell having top, bottom and side members;

(b) a molten metal collection zone comprising (1) an upper horizontal fluid-tight partition positioned below the top of the cell, the partition having a plurality of open risers extending above the upper surface of the partition, the riser tubes being in fluid communication with (2) a plurality of corresponding solid electrolyte tubes suspended from the upper partition, the tubes being joined to the upper partition in fluid-tight relationship at the upper end and closed at the lower end, and (3) outlet means for removing molten metal in the collection zone from the cell; and (c) an electrolyte circulation zone beneath the upper horizontal partition comprising (1) a plurality of positive pole assemblies, each connected with positive current collector means, positioned concentrically to the outer longitudinal surface of each of the solid electrolyte tubes, (2) outlet means for removing gas from the electrolyte circulation zone near the top thereof, and (3) inlet means for feeding electrolyte feed materials into the circulation zone.

In a preferred aspect of the invention, each of the solid electrolyte tubes contains inert solid material by which the amount of molten metal in the tubes during cell operation is reduced.

DETAILED DESCRIPTION OF THE INVENTION

Solid Electrolyte Materials

Suitable solid electrolyte materials must, of course, possess the primary properties of permeability to the flow of selected cations and impermeability to the flow of fluids, anions and other cations. In addition, these materials should possess to the highest practicable degree the following additional properties, which are important with respect to their functional and economic viability:

1. Low resistivity to flow of the specific cation
2. High resistivity to flow of electrons
3. High strength and density
4. Thermal shock resistance
5. Wettability by the molten metal and electrolyte
6. Close dimensional tolerance
7. Corrosion stability
8. Low fabrication cost
9. Long life.

The current state of the art with respect to solid electrolyte materials is such that the only reasonably suitable materials are relatively fragile glasses and polycrystalline ceramics, which are permeable to monovalent cations and impermeable to other species.

Among the glasses which may be used with such devices for the manufacture of sodium are those having the following composition: (1) between about 47 and about 58 mole percent sodium oxide, about 0 to about 15, preferably about 3 to about 12, mole percent of aluminum oxide and about 34 to about 50 mole percent of silicon dioxide; and (2) about 35 to about 65, preferably about 47 to about 58, mole percent sodium oxide, about 0 to about 30, preferably about 20 to about 30, mole percent of aluminum oxide, and about 20 to about 50, preferably about 20 to about 30, mole percent boron oxide. These glasses may be prepared by conventional glass making procedures using the listed ingredients and firing at temperatures of about 1480° C (2700° F).

The polycrystalline ceramic materials useful as reaction zone separators, i.e., as solid electrolytes, are bi- or multi-metal oxides. Among the polycrystalline bi- or multi-metal oxides most useful in the devices to which the process of this invention applies are those in the family of beta-alumina, all of which exhibit a generic crystalline structure which is readily identifiable by X-ray diffraction. Thus, beta-type alumina or sodium beta-type alumina is a material which may be thought of as a series of layers of aluminum oxide held apart by columns of linear Al-O bond chains with sodium ions occupying sites between the aforementioned layers and columns. Among the polycrystalline beta-type alumina materials useful as reaction zone separators (solid electrolyte) are the following:

1. Standard beta-type alumina which exhibits the above-discussed crystalline structure $O{\cdot}11Al_2$ series of layers of aluminum oxide held apart by layers of linear Al-O bond chains with sodium occupying sites between the aforementioned layers and columns. Beta-type alumina is formed from compositions comprising at least about 80% by weight, preferably at least about 85% by weight of aluminum oxide and between about 5 and about 15 weight percent, preferably between about 8 and about 11 weight percent, of sodium oxide. There are two well known crystalline forms of beta-type alumina, both of which demonstrate the generic beta-type alumina crystalline structure discussed hereinbefore and both of which can easily be identified by their own characteristic X-ray diffraction pattern. Beta-alumina is one crystalline form which may be represented by the formula $Na_2O{\cdot}11Al_2O_3$. The second crystalline form is $\beta''$-alumina which may be represented by the formula $Na_2O{\cdot}6Al_2O_3$. It will be noted that the $\beta''$ crystalline form of beta-type alumina contains approximately twice as much soda (sodium oxide) per unit weight of material as does the beta-alumina. The $\beta''$-alumina crystalline structure is by far the preferred material for making solid electrolytes for the invention because of its superior electrical properties, especially for sodium.

2. Beta-type alumina wherein about 0.1 to about 1 weight percent of boron oxide ($B_2O_3$) is added to the composition.

3. Substituted beta-type alumina wherein the sodium ions of the composition are replaced in part or in whole with other positive ions which are preferably metal ions.

4. Beta-type alumina which is modified by the addition of a minor proportion by weight of metal ions having a valence not greater than 2 such that the modified beta-type alumina composition comprises a major proportion by weight of ions of aluminum and oxygen and a minor proportion by weight of a metal ion in crystal latice combination with cations which migrate in relation to the crystal latice as a result of an electric field, the preferred embodiment for use in such electrical conversion devices being wherein the metal ion having a valence not greater than 2 is either lithium or magnesium or a combination of lithium and magnesium. These metals may be included in the composition in the form of lithium oxide or magnesium oxide or mixtures thereof in amounts ranging from 0.1 to 5 weight percent.

Methods of making $\beta$-alumina (including $\beta''$-alumina) are described inter alia in the following U.S. patents:

| | |
|---|---|
| Kummer et al | U.S. 3,404,035 |
| Kummer et al | U.S. 3,404,036 |
| Kummer et al | U.S. 3,413,150 |
| Tennenhouse | U.S. 3,446,677 |
| Kummer et al | U.S. 3,458,856 |
| Tennenhouse | U.S. 3,468,719 |
| Tennenhouse | U.S. 3,475,225 |
| Charles et al | U.S. 3,625,773 |
| McGowan et al | U.S. 3,895,963 |

In addition to the beta aluminas, other materials having interesting cation transport properties have been studied. For example, Bither et al in U.S. Pat. No. 3,980,499 disclose electrochemical devices using a solid electrolyte made from lithium haloboractie $Li_4B_7O_{12}X$ (X is halogen other than fluorine). Also, Goodenough et al have extensively studied the fast alkali-ion transport properties of the system $Na_{1+x}Zr_2P_{3-x}Si_xO_{12}$ (Mat. Res. Bull., Vol. 11, pp 203-220, 1976).

CELL CONSTRUCTION

The most economical configuration for commercial use of fragile solid electrolyte materials is a tube, preferably one having an effective L/D ratio of at least about 5:1 and, still more preferably, from about 15:1 to about 40:1. This configuration possesses much greater thin wall strength than a flat plate and can yield a high surface/volume ratio depending on tube diameter and packing density.

The invention is therefore primarily directed to the design of an electrolytic cell in which a plurality of solid electrolyte tubes is combined in a single cell in such manner as to provide highly efficient cell operation combined with a capability for continuing cell operation despite occasional tube failures.

Basically the cell is comprised of a closed shell having top, side and bottom members. An upper collection zone for molten metal is formed in the upper part of the cell by an upper horizontal partition positioned below the top of the cell. This partition functions primarily as a tube sheet from which a plurality of solid electrolyte tubes having closed lower ends is suspended. When the cell is in operation to separate sodium, for example, gas (usually chlorine) is formed outside the tubes at the anode and sodium is formed at the inner surface of the tubes. Liquid sodium thus formed then rises and fills the tubes and spills over onto the surface of the upper horizontal partition, from which it is drawn off by means of suitable draw-off channels and outlet lines or pipes.

A particularly important aspect of the invention is the use of risers atop the tube sheet. These risers provide liquid communication between the molten metal in the electrolyte tubes and the metal collection zone above. The risers do, however, perform the additional function of acting as a barrier or dam for the molten sodium. Thus, in the event one of the solid electrolyte tubes is broken below the tube sheet, the molten sodium atop the tube sheet will not flow into the electrolyte, but will be retained.

The risers can take several forms. For example, the upper part of the solid electrolyte tube itself or an extension thereof can be positioned in the tube sheet so that the upper part of the tube extends above the desired level of molten metal. On the other hand, short ring-like riser tubes can be mounted atop the tube sheets which are adapted to function as sleeve supports into which the electrolyte tubes are inserted from above. This latter configuration is preferred since utilization of the tube itself as riser entails the possibility that the riser portion of the electrolyte tube might also be broken and thus would fail in its function as a dam.

It is, of course, necessary to keep the chlorine and sodium from recombining. Therefore, it is necessary that the junction of the upper horizontal partition with the cell sidewalls, as well as the junction between the walls of each tube with the tube sheet or riser be fluid-tight, thus preventing the gas produced outside the tubes from entering the metal collection zone.

Each of the solid electrolyte tubes must contain a negative current collector, although metal formed in the process may serve this function in whole or in part. This is most easily done by having the upper horizontal partition, i.e., the tube sheet, also function as the negative current collector. However, when this is done, it will be necessary that the upper partition be insulated from the anodic parts of the cell.

It is preferred that the atmosphere in the upper collection zone in which the molten alkali metal is collected be maintained at a slight positive pressure with an inert gas. To do this, a small continuous flow of inert gas is maintained through the upper collection zone and, if desired, into the molten metal draw-off system.

The technical suitability of gases which may be used as inert gases during the production of alkali metals depends, of course, upon their degree of inertness toward the particular metal being produced in the molten state at the operating temperature. Carbon dioxide is too reactive with both lithium and sodium. On the other hand, nitrogen is sufficiently inert to be used in the presence of sodium but is unsatisfactory for lithium because it tends to form insoluble nitrides. For this reason, one of the inert gases, i.e., the zero group gases, is preferred. Of these, argon is most widely used.

It is foreseen that commercial scale cells constructed in accordance with the invention may contain a very high number of solid electrolyte tubes. The number of tubes is likely to be governed by consideration of heat removal, current distribution and fresh electrolyte distribution. However, it is anticipated that in cells of 200,000 amperes capacity, up to 1,000 tubes may be useful. In any cell having such a substantial number of tubes, it will be important economically that the tubes be laid out in such manner as to facilitate uniform liquid electrolyte circulation to each of the tubes and also, in the case of rod-type anodes, to facilitate anode sharing.

Surrounding each of the solid electrolyte tubes is a positive pole (anode) assembly, each of which is electrically connected with the positive current collector for the cell.

The positive pole assemblies can take many forms. For example, the positive pole assembly can be a non-foraminous cylindrical surface of anode material or it can consist of a concentric circular array of anode rods surrounding the electrolyte tubes. A perforate material such as gauze or wire mesh fabricated of anode material into tube form can also be used. When the above-described rod-type positive pole assembly is used, it is contemplated that many of the rods can be shared by two or more solid electrolyte tubes. For example, in a cell containing an hexagonal array of tubes each utilizing a positive pole assembly consisting of 18 rods, at least 6 of those can be shared with other electrolyte tubes.

The anode rods do not have to be constructed of solid positive pole material. For example, an anode metal can be plated on a less expensive substrate rod or the anode may consist of inert plastic filled with finely divided particles of positive pole material. In another variation, the positive pole can be constructed of metal wrapped in graphite felt.

Tungsten is a preferred positive pole material from the standpoint of operational life if a liquid electrolyte consisting of a mixture of sodium chloride and aluminum chloride is used. However, other conductive materials can also be used as anodes for this electrolyte, for example, certain forms of carbon such as graphite felt. As will be apparent to those skilled in the electrowinning art, the choice of anode will depend greatly upon the characteristics of the particular liquid electrolyte and the products therefrom.

The positive pole assemblies, of course, should be supported in such manner to assure that they are substantially concentric with the electrolyte tubes. The positive pole assemblies can be suspended from an intermediate horizontal partition positioned a short distance below the upper horizontal partition in the vapor space above the liquid electrolyte. When the positive pole assemblies are supported in this manner, the intermediate partition must contain a number of perforations which correspond to and are concentric with each of the tubes within the cell. The perforations are slightly larger than the tubes, by which an annulus is formed between the inner edges of the perforations and the outside wall of the solid electrolyte tubes. The intermediate partition is preferably located as near as possible to the top of the tubes in order not to waste usable tube electrolysis area. On the other hand, the volume of the zone formed between the upper and intermediate partitions should be sufficient to provide adequately for disengagement of the gas released at the anode assemblies, which is removed from the cell by means of the gas outlet means located within this collection zone.

As in the operation of conventional Downs cells, it will be preferred to maintain a slight vacuum on the gas exit line to prevent seepage of halogen gas into the work areas in which the cells are located.

It should be noted that the depth of the gas disengagement zone can be increased substantially without sacrificing tube electrolysis area by adding an inert tube extender to the open end of the solid electrolyte tubes. For example, an $\alpha$-alumina tubular extension of appropriate length can be cemented to the upper end of the tubes by means of a sintered glass cement or by use of ceramic cements of various kinds.

Alternatively, the positive pole assemblies can be supported on a lower horizontal partition near and preferably at or below the closed end of the electrolyte tubes. In addition to its function as a support for the lower end of the positive pole assembly, the lower horizontal partition may serve to facilitate even flow of molten salt electrolyte around the solid electrolyte tubes. Patterns of molten salt flowing through the cell will, of course, vary extensively depending upon the particular tube size, anode geometry and the array of tubes and anodes.

Those skilled in the art will recognize that it is important that the anode assemblies be spaced uniformly from the cathode in order to achieve uniform current density. Furthermore, it has been found that the life of the solid electrolyte is shortened by excessively high current density. For these reasons, in order to operate at high current densities consistent with acceptable tube life, it is preferred that the concentricity of the anode assemblies be uniform. To do this, it may in some instances be desired to support the anode assemblies at both the upper and lower ends from an upper and lower horizontal partition. This is especially true if the anode assemblies are constructed from less rigid materials.

The partitions used to support the anode assemblies can also function as a positive current collector for the cell. When used in this way, the partitions are constructed of suitable conductive material which will withstand the corrosive environment. The anode can be attached by such means as welding, brazing, staking screwed connections and the like. In a manner analogous to the upper horizontal partition, when the intermediate partition is used as the positive current collector, it must be insulated from the cathodic components of the cell. This can quite conveniently be accomplished for both instances by constructing the cell in two sections — an upper cathodic section and a lower anodic section — which are electrically insulated from each other by means of insulating gaskets between the sections.

During operation of the cell, circulation will take place as gas is liberated in the anode-cathode cell space and rises to the top of the anode section. However, this may not be sufficient to maintain adequate distribution of incoming salt throughout the inlet zone. It is, moreover, important for reasons of both thermal and electrical efficiency that the flow of liquid electrolyte be quite steady and that it be adequate in volume. For this reason, the liquid electrolyte circulation zone surrounding the anodes preferably contains agitation means, such as an outlet through which liquid electrolyte can be recirculated with fresh salt feed to the process. It is further preferred that the bath inlet to the cell be provided with some positive flow device to assure circulation and mixing.

For purposes of safety and the control of convection and radiation losses from the cell when it is in operation, it is preferred that portions of the cell be insulated on the outside with an appropriate insulation material such as magnesia or fiberglass. Especially when the cell is suitably insulated, those skilled in the art will recognize that the cell requires no separate heat source during operation and that an integral source of heat may not be required for startup. However, a heat source can be incorporated into the reaction vessel if desired. For example, electric heating elements can be affixed to the outer surface of the lower sidewalls or bottom of the cell.

An important feature of the invention, which is preferred from the standpoint of safety as well as economy, is a provision for reducing the volume of molten metal within the solid electrolyte tubes without concomitantly reducing the effective tube surface. It is, of course, known that the electrolyte tubes are quite fragile. Moreover, it has been found that the tubes may incur some weakening after they have been in operation for an extended period. It will therefore be appreciated that if an electrolyte tube undergoes catastrophic failure such as fracture, any molten metal therein may flow into the anode area and react vigorously with liquid electrolyte or with chlorine being released at the anodes. Though it is not practical completely to eliminate this risk, it can be reduced to insignificant levels by substantially filling the space inside the electrolyte tubes with inert solid material to reduce the volume of metal available for reaction.

The molten metal displacement means must not, however, block the passage of the selected metal ions. Furthermore, it is preferred that the displacement means be supported independently of the tubes so that, in the event of tube breakage or other catastrophic tube failure, the displacement means will not drop into the molten electrolyte bath surrounding the tubes. This is quite readily accomplished by suspending through the open top end of the tubes an insert made of inert material having an outer wall shape which conforms approximately with the inner wall shape of the electrolyte tube, but which is spaced therefrom so as to form a narrow annular space therebetween through which the molten metal can flow upwardly over the lip of the tube onto the surface of the molten metal collection zone. The molten metal displacement means can be made of any material which has suitable strength under the conditions of cell operation and which is inert with respect to both the liquid electrolyte and the molten metal. In the manufacture of sodium, iron, stainless steel, NaCl and α-alumina are very suitable displacement materials. Others include metal powders, felt, gauze or pellets and carbon black. Either solid or hollow shapes can be employed. When particulate solids are used for this purpose, they can be retained in an inert gauze sack or other suitable container.

DETAILED DESCRIPTION OF THE DRAWING

Figure 1:
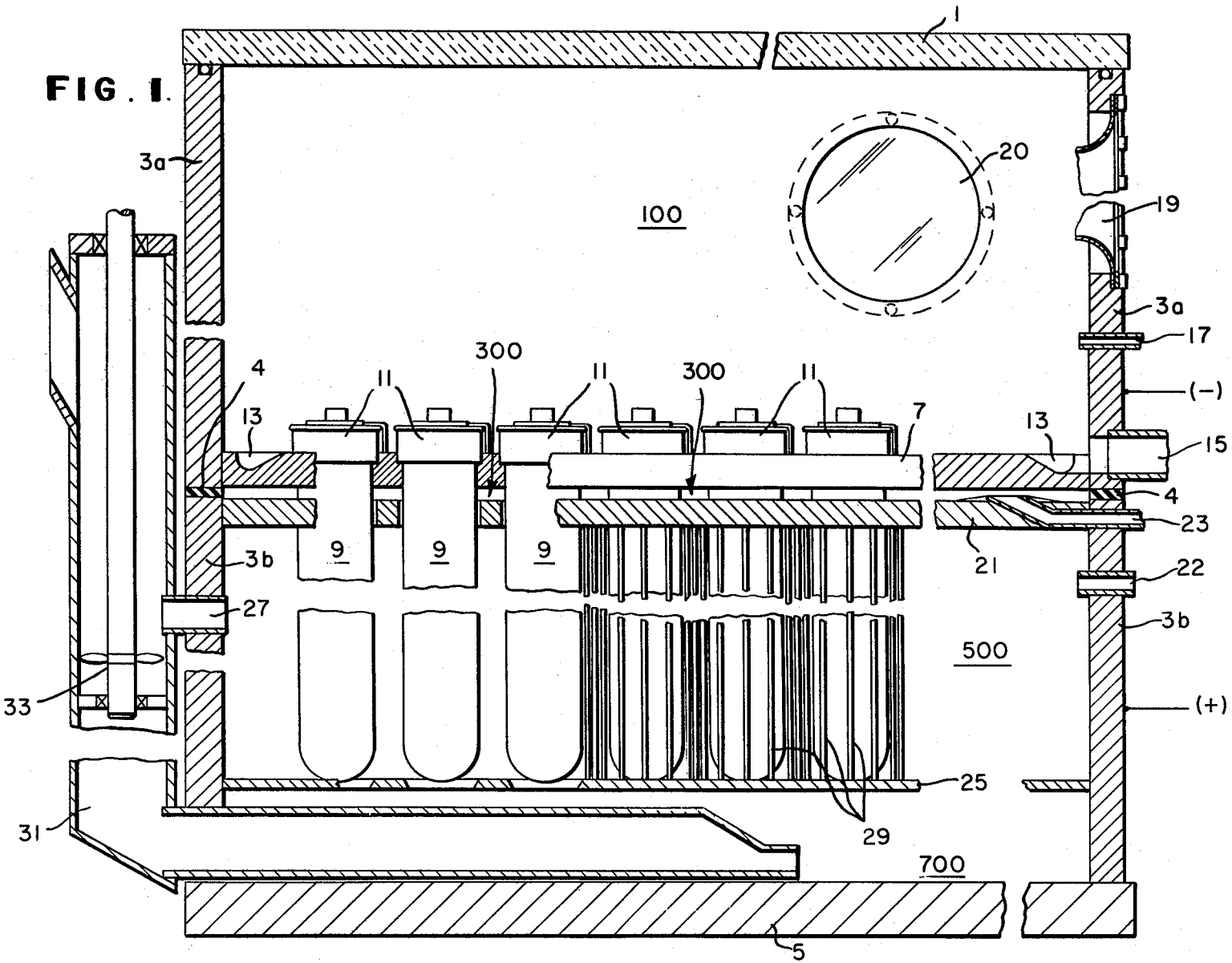
FIG. 1 is a vertical section of the separation cell.

Referring now to FIG. 1, a preferred form of the invention is shown comprising in combination an enclosed shell having a topwall 1, upper and lower sidewalls (3*a* and 3*b*, respectively) and a bottom wall 5. The topwall member 1 is constructed of transparent material, such as glass, to permit viewing into upper collection zone 100, which is formed by an upper horizontal fluid-tight partition 7 positioned below the top of the cell and extending between the upper sides of the cell 3*a*. The upper horizontal fluid-tight partition 7 functions as a tube sheet having joined thereto and suspended therefrom a plurality of cylindrical tubes 9, closed at the lower end and made of solid electrolyte material which is permeable to the flow of monovalent cations, such as $Na^+$, but impermeable to the flow of fluids, anions and polyvalent cations. The tubes are positioned and supported on the upper horizontal partition by means of open riser 11 which is joined in a fluid-tight manner to the partition. Though the tubes are closed at their lower ends, they are in fluid communication with the upper collection zone 100 at their upper ends in such manner that monovalent metal formed at the inner surface of the tubes is collected in the tube and rises within the tubes to overflow onto the top surface of the upper partition 7. Monovalent metal flowing onto the top of the upper partition 7 is removed from the cell via collecting channels 13 through outlet line 15. During normal operation of the cell, an inert atmosphere is maintained in the upper collection zone by maintaining a small flow of inert gas which is provided via inert gas inlet line 17. The upper collection zone 100 is also equipped through wall 3*a* with access means comprising a glove assembly 19 and access port 20 by which certain maintenance functions can be carried out within the upper collection zone 100 without having to remove the top member 1. In particular, when a tube fails, it is removed from the tube sheet using glove assembly 19. Access port 20, which during normal operation is sealed by means of a flange and bolted cover, is then opened and the failed tube is removed therethrough. The replacement tube can then be inserted into the metal collecting zone via the open access port 20. The access port is then resealed and the replacement tube is placed into operating position using glove assembly 19. During this operation, it will usually be preferred to purge the chlorine collection zone with inert gas which is supplied via a second inert gas inlet 22. In place of the bolted flange and cover used here, an air lock assembly might also be used.

In the cell illustrated in the Drawing, the open ends of the solid electrolyte tubes 9 (or inert extensions thereof) protrude above the surface of the tube sheet 7 and are supported atop the tube sheet by riser 11 above the desired liquid level on the sheet. By this arrangement, when a tube is broken, molten metal in the metal collection zone will drain off in its usual path and will not drain into the electrolyte circulation zone through any opening left by the fractured tube.

The upper horizontal partition 7 as well as the upper sidewalls of the cell 3*a* are constructed of electrically conductive material and together function as negative current collector for the cell. The upper part of the cell is insulated electrically from the lower part of the cell by means of insulating gasket 4 placed between the abutting edges of the upper and lower cell sidewalls.

An intermediate horizontal partition 21 extending between the lower sides of the cell 3*b* is positioned below the upper horizontal partition 7, thus forming a lower second collection zone 300 in which gas formed outside the solid electrolyte tubes 9 is collected. Gas within zone 300 is removed from the cell through gas outlet line 23. The intermediate horizontal partition is perforated in such manner that an annular space is formed between the edge of the perforations and the outer surfaces of the solid electrolyte tubes 9 near the upper end thereof.

Positioned near the closed lower end of the solid electrolyte tubes is a lower horizontal partition 25 which, with the intermediate partition 21, forms an electrolyte circulation zone 500 surrounding the solid electrolyte tubes 9. The lower horizontal partition 25 is also provided with perforations through which molten electrolyte flows into the zone and around the solid electrolyte tubes. Molten electrolyte is discharged from circulation zone 500 through liquid electrolyte discharge line 27.

Extending between the intermediate and lower horizontal partitions 21, 25 in close proximity with each solid electrolyte tube 9 is a positive pole assembly comprised of a plurality of metal rods 29 positioned in circular array around the solid electrolyte tube 9. In the cell illustrated in FIG. 1, both the intermediate partition 21 and the lower sidewall 3*b* are constructed of electrically conductive material and together function as positive current collector for the cell.

The lower horizontal partition 25 separates the circulation zone of the cell 500 from a molten salt inlet zone 700. Feed materials are passed to the cell through feed line 31. A positive flow of salt feed and recirculation of molten salt is maintained by operation of impeller assembly 33, which is located within the salt feed line 31.

Figure 2:
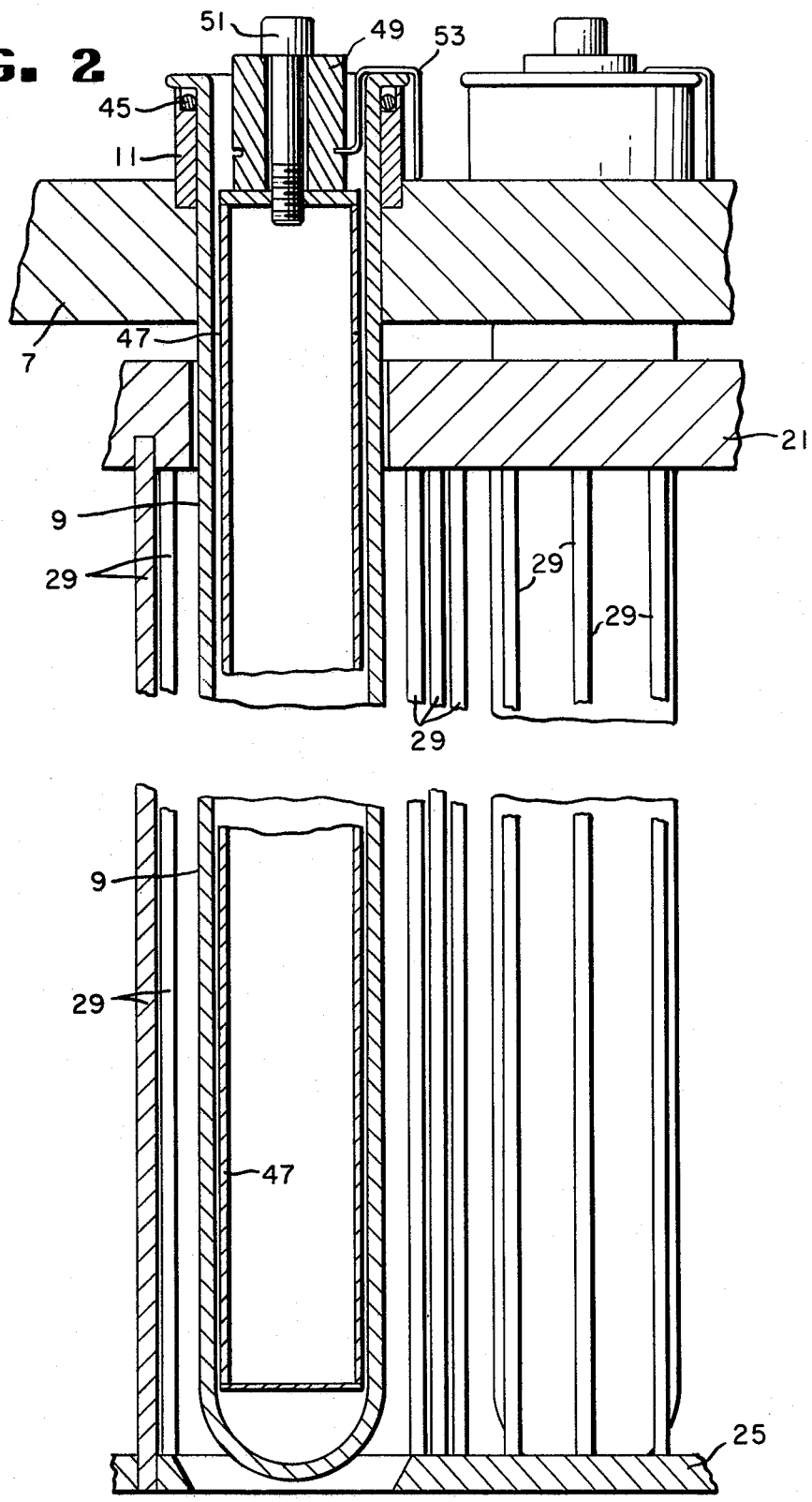
FIG. 2 is a representation in vertical section showing in detail a single solid electrolyte tube and electrode assembly.

FIG. 2 is a detailed representation of the solid electrolyte tube and positive pole assemblies. Solid electrolyte tube 9 is supported atop upper horizontal partition 7 by means of riser 11, which is made of the same conductive material as the upper horizontal partition. A fluid-tight relationship between the outside of the solid electrolyte tube and the sodium collection zone atop partition 7 is maintained by O-ring gasket 45. Positioned within the solid electrolyte tube 9 is a tubular insert 47 and insulating ring 49, which serve to displace and thus reduce the volume of sodium which is contained in the cell by limiting it to the volume of the small annulus between the inner wall of the electrolyte tube 9 and the outer wall of the sodium displacement tube 47. The displacement tube 47 is positioned and supported within the solid electrolyte tube 9 by a support assembly comprising ring 49 which is affixed to the displacement tube 47 by cap screw 51. Ring 49 is grooved around its circumference to accommodate an electrically conductive clip 53 which serves to support and position the displacement tube 47 and support assembly within the solid electrolyte tube 9. The clip also serves to assure an electrically conductive path between the molten sodium metal within the solid electrolyte tube 9 and the upper horizontal partition 7, the latter of which also functions in this instance as the negative current collector (cathode) for the cell. In addition, this assembly also functions as a switch to shut off electrical flow to the tube when the molten metal level drops below the level of the conductive clip, for example, when the tube is fractured. By looking through glass top member 1, it can be determined whether the tubes are operable or whether they are operating at a reduced rate. In the event that this does happen with a given tube assembly, the tube can be switched "off" after purging the chlorine collection zone by lifting the tube insulating ring 49, insert 47, and clip 53 a short distance, e.g., 1 cm, which has the effect of lifting the lower end of clip 53 out of contact with the molten sodium on the upper surface of partition 7, thereby breaking the electrical circuit. Subsequently, the components may be removed and replaced, as necessary, by functional ones.

Solid electrolyte tube 9 is surrounded by a concentric circular array of 18 tungsten rods 29 spaced evenly around the outside of the solid eletrolyte tube 9. The tops of the rods 9 are brazed to intermediate horizontal partition 21 and therefore constitute a positive pole assembly for the cell when, as here, the intermediate horizontal partition 21 also serves as the positive current collector. The lower ends of the tungsten rods are anchored to lower horizontal partition 25 in order to accure accurate positioning of the rods with respect to the outer wall of the solid electrolyte tubes 9.

Operating Procedures

When the above described cell is assembled and the appropriate feed, product and electrical connections are made, startup of the cell is quite easy. This is illustrated by the following procedure for starting up and operating the cell of the invention for the manufacture of sodium from an approximately equimolar mixture of NaCl and $AlCl_3$.

Appropriate quantities of granular NaCl and $AlCl_3$ are fed to a solids blender, such as a ribbon mixer, to form an uniform mixture of the two materials. The thusly mixed granular salts are then placed in a suitably heated melt tank in which they are melted by heating to 200°–250° C, which is well above the solidus of the bath. The molten salt feed mixture is pumped to the inlet of the cell and the circulation zone is filled up to the level of the electrolyte discharge line. Circulation of the feed throught the cell is then established.

After bath circulation is started, the space within the molten metal collection zone is purged with inert gas and the solid electrolyte tubes are then filled with molten sodium to a level sufficient to provide electrical contact with the upper horizontal partition.

The cell is then started merely by turning on the power to the cell which can be done either gradually or fully at once. Operation of the cell is then continued with either continuous or bath addition of granular NaCl to the cell at a rate to maintain the NaCl composition of the molten salt bath at the desired level.

The cell of the invention, when making sodium at 200° C, operates at a voltage of 6 as compared to about 7 for conventional Downs cells making sodium at 600° C. Average current (coulombic) efficiency for the invention cell is essentially 100% compared to a range of 80–90% for Downs cells. Power consumption of the invention at the same productivity is about 30% lower than the Downs cell.

After extended operation of the cell, some of the electrolyte tubes may become less efficient because the sodium ion passages become blocked with extraneous ions. In some instances of such blockage, it has been found that the degree of blockage can be reduced by reversing the polarity of the cell for a short time. Thus, tube life can frequently be extended in this way.

Whenever any of the tubes in the cell are broken and/or have to be replaced for any reason, power to the cell is cut off and the chlorine is purged out of the collection zone with inert gas. The inert atmosphere in the metal collection zone is also maintained during this operation. Tubes are then replaced in the manner described hereinabove in the description of the Drawing.

I claim:

1. A cell for the electrochemical separation of metals from electrodissociatable compounds thereof in the molten state having
   (a) an enclosed shell having top, bottom and side members;
   (b) a molten metal collection zone comprising
      (1) an upper horizontal fluid-tight partition positioned below the top of the cell, the partition having a plurality of open risers extending above the upper surface of the partition, the riser tubes being in fluid communication with
      (2) a plurality of corresponding solid electrolyte tubes suspended from the upper partition, the tubes being joined to the upper partition in fluid-tight relationship at the upper end and closed at the lower end,
      (3) negative current collector means extending into the upper end of each of the solid electrolyte tubes, and
      (4) outlet means for removing molten metal in the collection zone from the cell; and
   (c) an electrolyte circulation zone beneath the upper horizontal partition comprising
      (1) a plurality of positive pole assemblies, each connected with positive current collector means, positioned concentrically to the outer longitudinal surface of each of the solid electrolyte tubes,
      (2) outlet means for removing gas from the electrolyte circulation zone near the top thereof, and
      (3) inlet means for feeding electrolyte feed materials into the circulation zone.

2. The cell of claim 1 in which the electrolyte circulation zone is provided with agitation means.

3. The cell of claim 2 in which the agitation means is comprised of outlet means for removing liquid electrolyte from the circulation zone at a level below the gas outlet means in fluid communication with the electrolyte feed inlet means so that liquid electrolyte removed from the zone can be recirculated to the circulation zone in admixture with electrolyte feed materials.

4. The cell of claim 1 in which the positive pole assemblies are suspended from an intermediate horizontal partition positioned below the gas outlet means, the intermediate horizontal partition having a plurality of perforations concentric to each of the solid electrolyte tubes by which an annulus is formed between the edge of each perforation and the outer longitudinal surface of each of the solid electrolyte tubes.

5. The cell of claim 1 in which the positive pole assemblies are supported on a lower horizontal partition positioned near the closed ends of the solid electrolyte tubes, the lower horizontal partition being perforated to allow the flow of liquid electrolyte therethrough.

6. The cell of claim 5 in which the positive pole assemblies are also supported at the upper end from an intermediate horizontal partition positioned below the gas outlet means, the intermediate horizontal partition having a plurality of perforations concentric to each of the solid electrolyte tubes by which an annulus is formed between the edge of each perforation and the outer longitudinal surface of each of the solid electrolyte tubes.

7. The cell of claim 1 in which the positive pole assemblies are comprised of solid cylindrical surfaces of conductive material.

8. The cell of claim 7 in which the positive pole assemblies are joined together laterally to form a rigid integral structure supported by the side or bottom members of the cell.

9. The cell of claim 1 in which each of the positive pole assemblies is comprised of a plurality of conductive material rods spaced equidistantly in the configuration of a circle which is concentric to the electrolyte tubes.

10. The cell of claim 1 in which the positive pole assemblies are comprised of perforate cylinders of conductive material.

11. The cell of claim 10 in which the positive pole assemblies are tubes formed from a gauze or wire mesh of conductive material.

12. The cell of claim 1 in which the selected cation is monovalent and the solid electrolyte tubes are fabricated of sodium $\beta''$-alumina.

13. The cell of claim 4 in which the intermediate horizontal partition functions as positive current collector means.

14. The cell of claim 5 in which the lower horizontal partition functions as positive current collector means.

15. The cell of claim 8 in which the supporting cell member functions as positive current collector means.

16. The cell of claim 1 in which the positive pole assemblies are constructed of tungsten metal.

17. The cell of claim 9 in which the rods are fabricated from nickel wrapped in graphite felt.

18. The cell of claim 1 in which the positive pole assemblies are constructed of inert plastic filled with finely divided particles of positive pole material.

19. The cell of claim 1 in which the positive pole assemblies are constructed of graphite.

20. The cell of claim 1 in which the space within the electrolyte tubes is filled with inert solid material to reduce the volume of liquid which can be contained by the tubes.

21. The cell of claim 20 in which the inert solid material is an electron conductive metal, which functions as negative current collector means.

22. The cell of claim 20 in which the inert solid material is $\alpha$-alumina.

23. The method of separating a selected metal from an electrodissociatable compound thereof comprising (a) passing a liquid electrolyte stream containing the compound through the electrolyte circulation zone of the cell of claim 1 while applying an electrical potential between the positive and negative poles of the cell;

(b) removing gas dissociated from the compound from the cell through the gas outlet means;

(c) removing molten selected metal from the cell through the molten metal outlet means; and (d) replenishing the content of compound in the liquid electrolyte.

24. The method of claim 23 in which replenishment of the content of compound in the liquid electrolyte depleted in its content of compound from the cell and admixing it with the compound of step (a).

* * * * *

UNITED STATES PATENT OFFICE

CERTIFICATE OF CORRECTION

PATENT NO. : 4,089,770

DATED : May 16, 1978

INVENTOR(S) : Charles H. Lemke

It is certified that error appears in the above-identified patent and that said Letters Patent are hereby corrected as shown below:

In Claim 24 at Column 14, line 35, after "electrolyte" insert -- is carried out by removing liquid electrolyte --.

Signed and Sealed this

*Tenth* Day of *October 1978*

[SEAL]

*Attest:*

RUTH C. MASON
*Attesting Officer*

DONALD W. BANNER
*Commissioner of Patents and Trademarks*